US005915729A

United States Patent [19]

Vap

[11] Patent Number: 5,915,729

[45] Date of Patent: Jun. 29, 1999

[54] THREE-DIMENSIONAL BOOK

[75] Inventor: Rudolph D. Vap, Cincinnati, Ohio

[73] Assignee: Vap Creative Limited, Cincinnati, Ohio

[21] Appl. No.: 08/979,678

[22] Filed: Nov. 26, 1997

[51] Int. Cl.[6] ..... B42D 1/08

[52] U.S. Cl. ..... 281/22; 281/51; 434/269; 446/73; 446/75

[58] Field of Search ..... 281/22, 38, 51; 446/147, 73, 75; 273/157 R; 434/262, 267, 269, 272, 274

[56] References Cited

U.S. PATENT DOCUMENTS

| | | | |
|---|---|---|---|
| 1,011,833 | 12/1911 | Newell . | |
| 1,028,921 | 6/1912 | Wagner | 283/63.1 |
| 1,139,643 | 5/1915 | Cross . | |
| 1,490,295 | 4/1924 | Stephens . | |
| 2,177,946 | 5/1939 | Cresswell et al. . | |
| 2,484,895 | 10/1949 | Links . | |
| 2,489,240 | 11/1949 | Meyer | 446/147 |
| 2,678,505 | 5/1954 | Munson . | |
| 2,882,619 | 4/1959 | Gloeckner . | |
| 2,918,731 | 12/1959 | Warhaftig et al. . | |
| 2,946,137 | 7/1960 | Worth et al. . | |
| 3,191,319 | 6/1965 | Waisgerber . | |
| 3,274,706 | 9/1966 | Friend . | |
| 3,325,917 | 6/1967 | Kinnaman . | |
| 3,659,367 | 5/1972 | Yumoto . | |
| 4,176,473 | 12/1979 | Rae . | |
| 4,337,576 | 7/1982 | Drost et al. . | |
| 4,819,963 | 4/1989 | Wolski . | |
| 4,874,340 | 10/1989 | Smallwood . | |
| 4,909,542 | 3/1990 | Marks . | |
| 5,178,542 | 1/1993 | Chigrinsky et al. . | |
| 5,240,110 | 8/1993 | Reichenbach, III et al. . | |
| 5,356,295 | 10/1994 | Grosz . | |
| 5,419,706 | 5/1995 | Levy et al. . | |
| 5,480,341 | 1/1996 | Plakos . | |

FOREIGN PATENT DOCUMENTS

| | | |
|---|---|---|
| 0186930 | 9/1986 | European Pat. Off. . |
| 2552574 | 3/1985 | France . |
| 4212908 | 10/1993 | Germany . |
| 4288583 | 4/1992 | Japan . |
| 0075957 | 9/1954 | Netherlands . |
| 2156737 | 10/1985 | United Kingdom . |

*Primary Examiner*—Andrea Pitts
*Assistant Examiner*—Monica Smith
*Attorney, Agent, or Firm*—Wood, Herron & Evans, L.L.P.

[57] ABSTRACT

An instructional book for children which enables the reader to remove and play with a plurality of removable parts housed within recesses formed in the pages of the book. Two of the pages of the book have a half shell integrally formed therein in the shape of an object which is the subject of the text of the book. The half shells cooperate to form a hollow three-dimensional shell which is adapted to receive one or more of the removable parts stored within the book in order to aid in the learning process of the reader.

28 Claims, 4 Drawing Sheets

THREE-DIMENSIONAL BOOK

FIELD OF THE INVENTION

This invention relates to the field of instructional books. More particularly, this invention pertains to a book adapted to house multiple removable parts which serve to compliment the text printed on the pages of the book and thereby enhance the learning process of the reader.

BACKGROUND OF THE INVENTION

It is sometimes difficult to interest young children in reading books. Children often loose interest in reading conventional books. It is well recognized that the reading and learning processes are enhanced when the child's interest is maximized in some manner.

The prior art has addressed this problem by incorporating entertainment features into children's books to enhance the children's interest in the book. Such books have been designed so that the books are visually attractive and have eye catching features. Such entertainment features have comprised, for example, pop up figures, puppets or other items which are attached to or coordinated with a book.

A child's desire to read may be limited by the attention span of the child. A young child may pick up a conventional book and initially be interested in the book because the child can touch and feel the cover and exterior surfaces of the book. However, once the child becomes familiar with the outline of the book the child may become disinterested in the book. Since children have a natural attraction for toys and small physical objects, often children are more attentive and will want to read a book longer if a toy or small physical object is associated with the book.

The learning process may be further enhanced if a child is able to see, touch and/or feel a three-dimensional object being discussed on the pages of a book. Often times, simply having the child read the words is inadequate for the child's complete understanding of the material printed on the book pages. A child may be better able to understand the subject matter of the book if the child is able to touch or feel a three-dimensional object which is representative of the subject matter of the book.

The prior art includes several books which incorporate removable toys or figurines which aid in the learning process while a child is reading the book. U.S. Pat. No. 4,176,473 discloses a book containing removable three-dimensional figures fabricated of molded plastic which are frictionally held within the pages of the book, the pages of the book having cut out portions therein. The figures can be removed from the pages of the book and used as a toy to reinforce the learning process. With this book however, once the figures have been removed from the inside of the book, the remaining pages are substantially planar in nature so that if the figures are lost or removed the book may lose its attractiveness to children.

Another patent which discloses a removable toy housed between the front and back covers of a book is disclosed in U.S. Pat. No. 1,490,295. The book disclosed in this patent has a story telling section comprising a plurality of planar pages and a toy holding section having a generally hollow compartment housing one or more toys which the reader may remove from the toy holding section of the book by lifting up on a portion of the toy holding section.

In addition to books incorporating removable figures or toys which may speed up the learning process of the reader, other books have been designed which have an abnormal configuration in order to increase the interest of a child reader. These books do not have a conventional planar front and back cover but rather have covers which make the book three-dimensional.

U.S. Pat. No. 4,909,542 discloses a book shaped as a creature having a back cover and a front cover which comprise layers of soft material. Multiple limbs of the creature the book is attempting to represent may be attached to the front or back covers.

U.S. Pat. No. 4,819,963 discloses a book which may be used as a three-dimensional sculpture. A plurality of planar pages are located between two bifurcated portions. Each bifurcated portion is three-dimensional and in the shape of half of a fish sculpture. When the book is in the closed position the inner pages are not discernable and the exterior of the book appears to be a three-dimensional fish sculpture.

Even with books having non-conventional covers, a child's interest still may not be adequately captured without one or more educational pieces which the child may touch and feel and play with while the child is reading the book. A book having such figures housed therein may be more attractive to a child and aid in the child's learning process when the child reads the book.

Therefore, it is one objective of the present invention to provide an instructional book capable of housing multiple removable parts which the reader may touch and play with while reading the book thus enhancing the reader's understanding of the subject matter of the book.

It is a further objective of the present invention to provide a book which is non-conventional in shape and has non-planar pages to increase a child's interest in the book.

It is a further objective of the present invention to provide a book having multiple pages which are three-dimensional and adapted to house and receive one or more removable pieces.

SUMMARY OF THE INVENTION

The invention of the application which accomplishes these objectives comprises an instructional book having a front cover page, a back cover page and a plurality of inner pages sandwiched between the front and back cover pages. A first one of the pages has a top half shell integrally formed in the page and a second one of the pages has a bottom half shell integrally formed in the page. The half shells are in the shape of an animal or object which is the subject of the instructional book. The half shells cooperate when the first and second pages are pressed together so as to form a hollow three-dimensional shell which is capable of storing one or more removable body parts including a skeleton of the animal depicted by the hollow three-dimensional shell. The pages are bound together with a binding means as is conventional in the construction of books along a common edge of the pages, typically the leftmost edge, so that the reader can flip the pages from right to left.

In the preferred embodiment of the present invention, the front cover page is a planar cover page and does not have a half shell integrally formed therein. Further, all of the inner pages except the rearmost inner page are also planar, each having a cut out portion in the configuration of the hollow three-dimensional half shell. These cut out portions enable the top half shell to pass through the cut out portions so that the pages may lie flat upon one another. The front cover page may also have a similar cut out portion.

In this preferred embodiment, the rearmost inner page is the page which has the top half shelf integrally formed therein and the back cover page is the page which has the bottom half shell integrally formed therein. In addition to containing the bottom half shell, the back cover page may have a plurality of recesses formed therein which are adapted to hold one or more instructional removable parts, typically body parts of the animal depicted by the hollow three-dimensional shell. Each of these recesses has a flat bottom so as to enable the back cover page to lie flat on a supporting surface such as a desk top with sufficient stability. In order to hold the removable parts in the recesses integrally formed in the back cover page, the rearmost inner page which contains the top half shell also may have a plurality of recesses formed therein which are sized and adapted to fit inside the recesses formed in the back cover page so that when the book is closed the removable parts are held in place.

Because the book is an instructional book, selected of the pages, including the front cover page and back cover page, may have text written thereon describing the different parts of the anatomy of the animal depicted by the hollow three-dimensional shell. In this way, a child may learn about the different body parts of the animal and the learning process is enhanced by the ability of the child to touch and feel the representations of the different body parts including the skeleton which are housed inside the recesses and the hollow three-dimensional shell integrally formed in selected pages. The reader is able to inspect the different removable body parts including the skeleton while reading about them.

These and other objects and advantages of this invention will be more readily apparent from the following description of the drawings in which:

DETAILED DESCRIPTION OF THE PREFERRED EMBODIMENT

Figure 1:
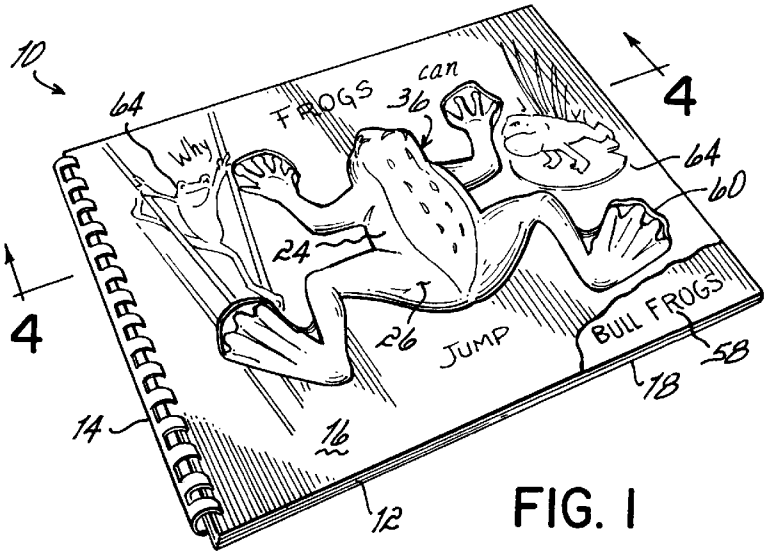
FIG. 1 is a perspective view of the instructional book of the present invention.

Referring to the drawings and, particularly, to FIG. 1, there is illustrated an instructional book 10. The instructional book comprises a plurality of generally rectangular pages 12 bound together along the left edge of the pages with a conventional binding means or binder 14. Although one specific type of binder is illustrated, other binders such as three notebook rings may be used to bind the pages together in accordance with the present invention.

Figure 2:
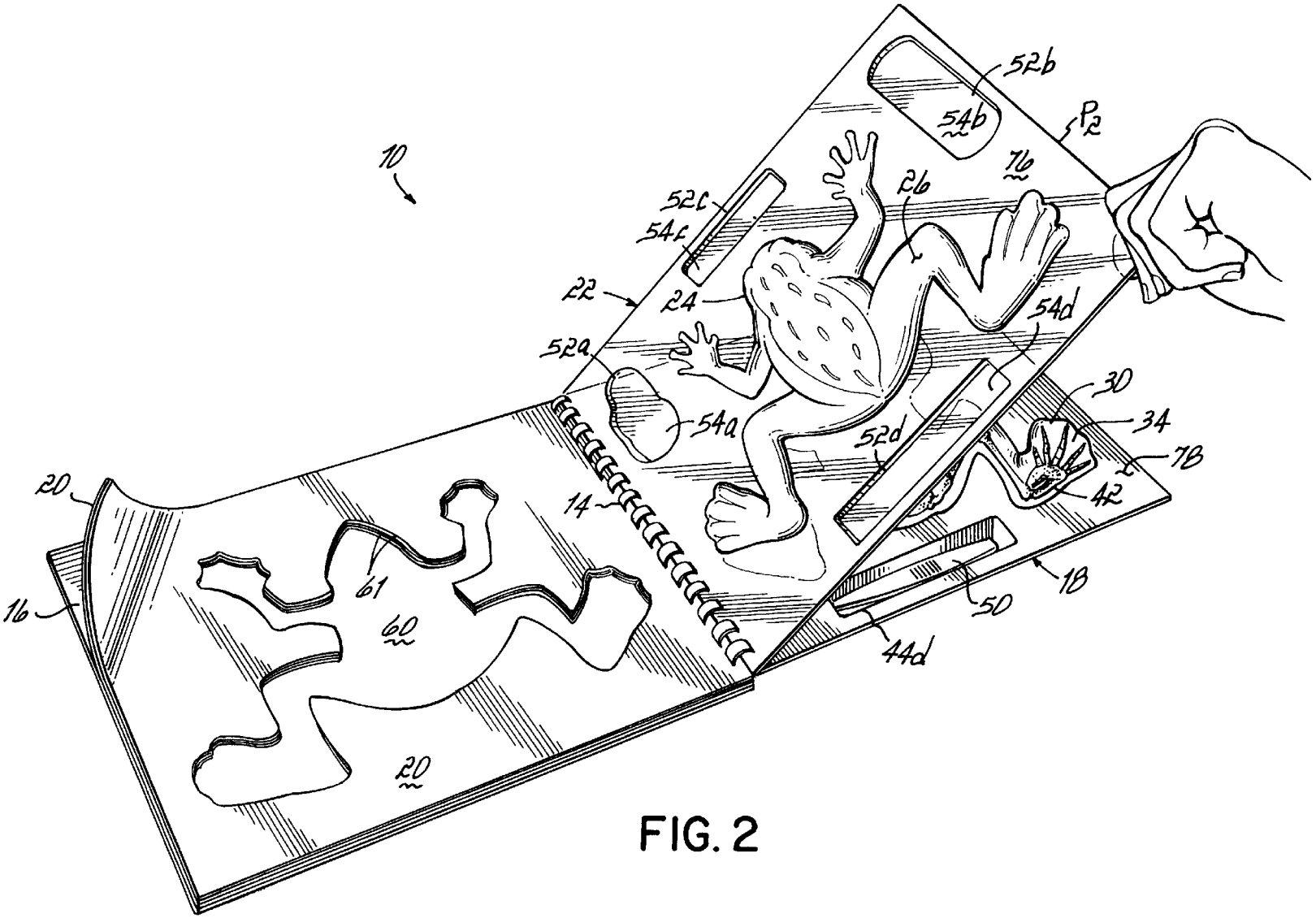
FIG. 2 is a perspective view of the instructional book of FIG. 1 with the rearmost inner page lifted up so as to clearly illustrate the top half shell integrally formed in the rearmost inner page.

Referring to FIGS. 1 and 2, the instructional book 10 comprises a front cover page 16, a back cover page 18 and a plurality of inner pages 20 sandwiched between the front and back cover pages 16, 18.

In the preferred embodiment of the present invention, the front cover page 16 is substantially planar. As best illustrated in FIG. 2, along with the front cover page 16 being substantially planar, a plurality of the forwardmost inner pages 20 are substantially planar as well. The pages may or may not be laminated.

Figure 3:
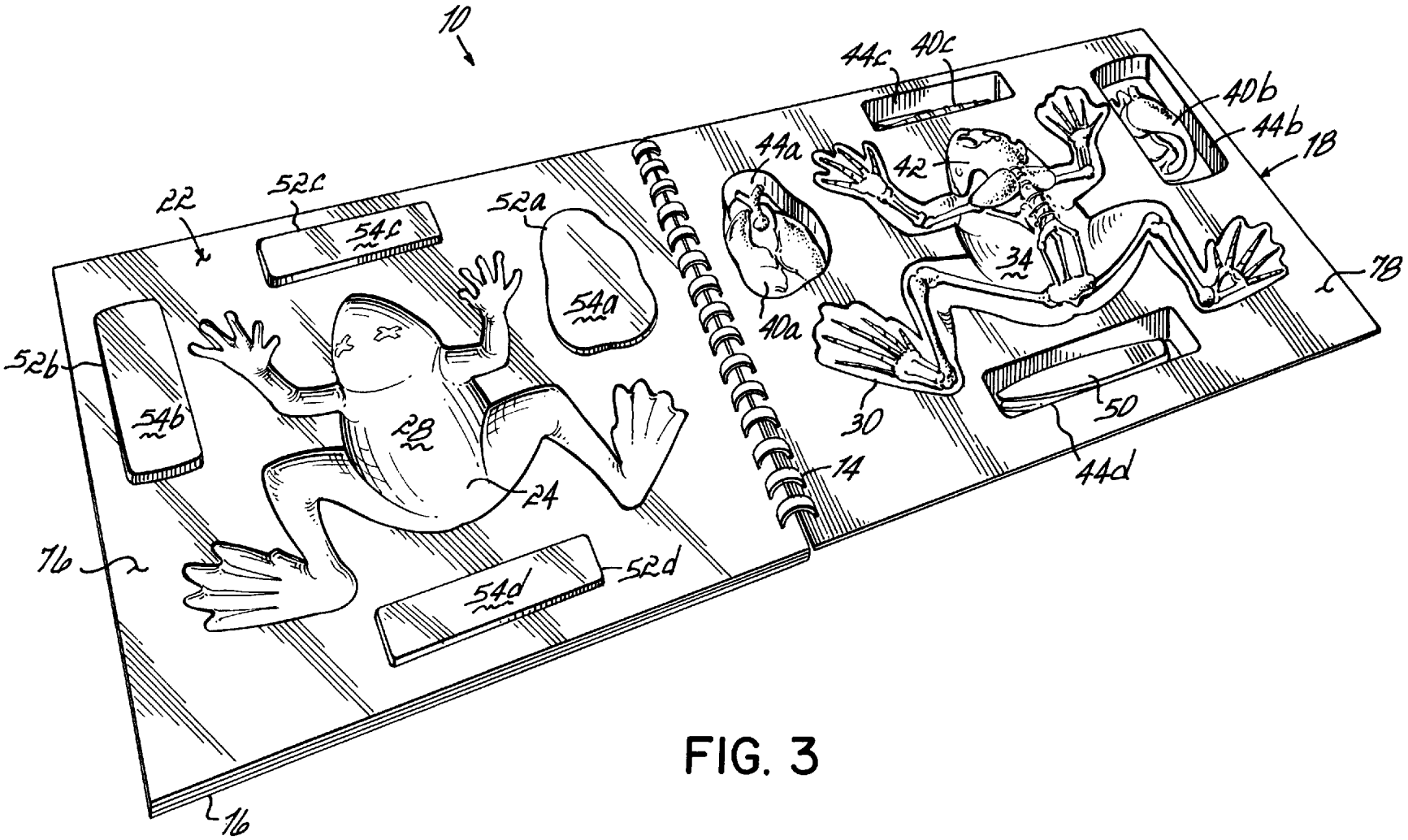
FIG. 3 is a perspective view of the instructional book of FIG. 1 opened between the rearmost inner page shown on the left of the binder and the back cover page illustrated to the right of the binder with the removable parts shown in the recesses and a skeleton illustrated in the bottom half shell integrally formed in the back cover page.

A rearmost inner page 22 has a top half shell 24 integrally formed in the page in the shape of an animal, in the figures a frog. Although a frog is illustrated, the top half shell 24 may take the form of other animals or objects as well. As seen in FIGS. 2 and 3, the top half shell 24 of the frog is bowed outwardly toward the top of the book or toward the front cover page 16 and has a convex outer surface 26 and a concave inner surface 28 (see FIGS. 2 and 4). The area 76 of the rearmost inner page 22 surrounding the top half shell 24 is substantially planar (defining a plane $P_2$) enabling the inner pages 20 to lie flat on the rearmost inner page 22 when the book is in a closed or partially closed position. The top half shell 24 protrudes above the plane $P_2$ when all the book's pages are closed.

Figure 4:
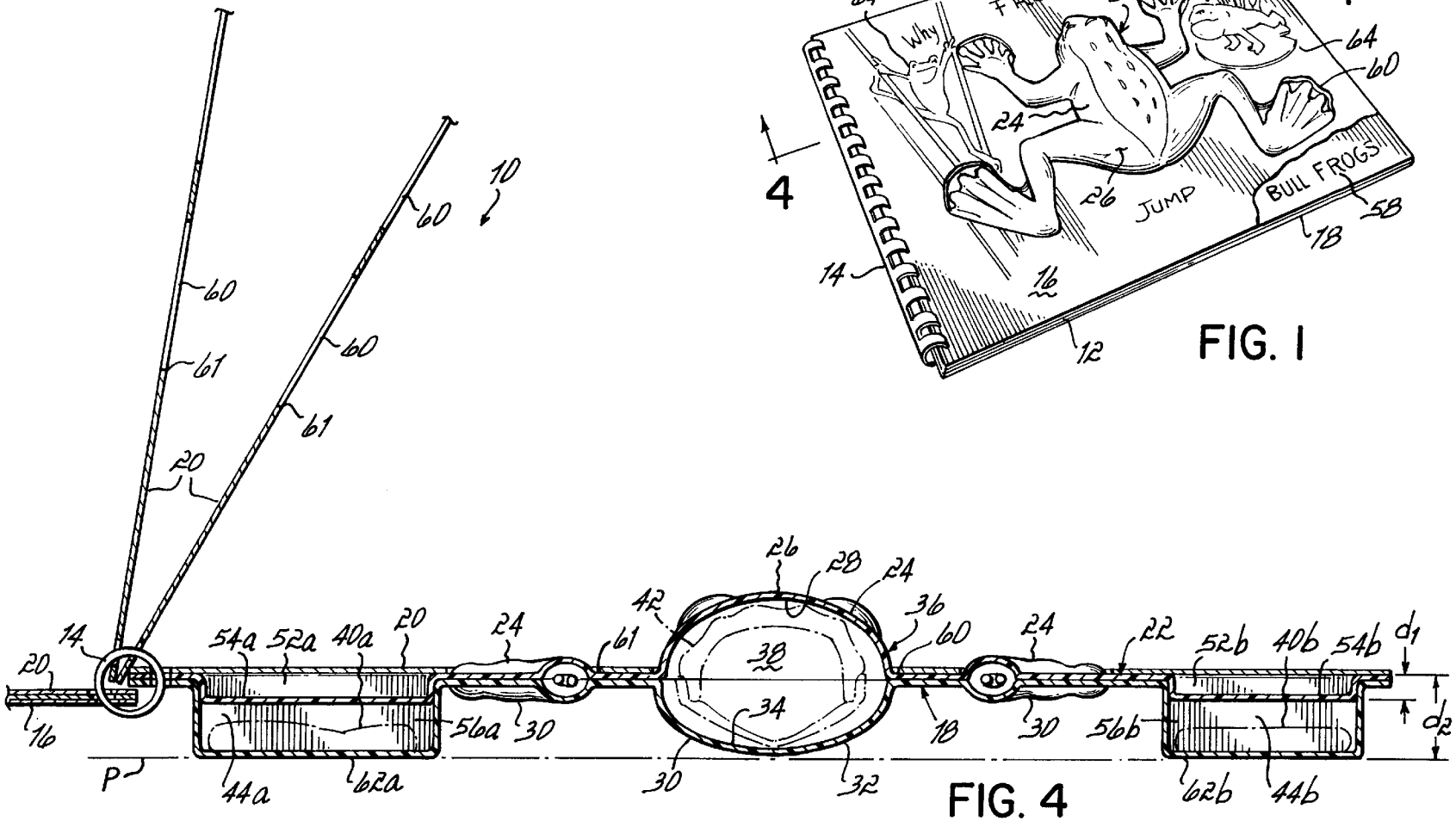
FIG. 4 is a cross-sectional view taken along the lines 4—4 of FIG. 1 with the front cover page opened and several inner pages lifted upwardly.

The back cover page 18 also has a half shell integrally formed therein, in this case a bottom half shell 30. As best seen in FIG. 4, the bottom half shell 30 bows or protrudes downwardly and has a convex outer surface 32 and a concave inner surface 34 (see FIGS. 3 and 4). The area 78 surrounding the bottom half shell 30 is also substantially planar so as to enable the rearmost inner page 22 to lie flat against the back cover page 18 when the book is closed. The top half shell 24 and the bottom half shell 30 form a hollow three-dimensional shell 36 when the rearmost inner page 22 is laid flat on the back cover page 18. The hollow three-dimensional shell 36 has a hollow interior 38 adapted to receive at least one removable part (see FIGS. 2, 3 and 4). One of the removable parts may take the form of a skeleton 42 which is adapted to be stored inside the hollow interior 38 of the three-dimensional shell 36, as seen in FIGS. 3 and 4.

Referring now to FIGS. 2 and 3, the back cover page 18 also may have integrally formed therein a plurality of recesses 44*a*, 44*b*, 44*c*, 44*d*. The recesses 44*a*, 44*b*, 44*c* are sized and adapted to receive different parts 40*a*, 40*b*, 40*c* which are representative of body parts typically found in the animal depicted by the hollow three-dimensional shell. For example, recess 44*a* is illustrated as containing one part 40*a* (for example, a representation of a liver) typically found inside the interior of the frog. Likewise, recesses 44*b*, 44*c* are illustrated as housing other parts 40*b*, 40*c* representations of the intestine of the frog and the spinal cord respectively. These different parts 40*a*, 40*b*, 40*c* may be made of rubber or any other type of material and may be picked up and inspected by the reader and inserted inside either the bottom half shell 30 or the top half shell 24 by the reader. Thus, while reading the book, a child's interest is captured and maintained because the child may physically touch and feel the object about which the child is reading. Additionally, the child can insert and remove at his or her will the different parts 40*a*, 40*b*, 40*c* including the skeleton 42 of the animal about which the child is reading. In order to aid in picking up the different parts, a pair of tweezers or a like instrument 50 may be inserted and maintained inside one of the recesses 44*d* as illustrated in FIG. 3.

As best illustrated in FIG. 2, the rearmost inner page 22 may also have a plurality of recesses 52*a*–52*d* formed therein which are not intended to house individual removable parts. Instead, each of the recesses 52*a*–52*d* have a flat bottom surface 54*a*–54*d*, respectively, which serve as covers for the recesses 44*a*–44*d* integrally formed in the back cover page 18 when the pages are closed. As best illustrated in FIG. 4, the depth $d_1$ of the recesses 52*a*–52*d* of the rearmost inner page 22 is less than the depth $d_2$ of the recesses 44*a*–44*d* of the back cover sheet so as to provide spaces 56*a*–56*d* between the bottom surfaces 54*a*–54*d* of recesses 52*a*–52*d* and the bottoms 62*a*–62*d* of the recesses 44*a*–44*d*. These spaces 56*a*–56*d* are adapted to hold one or more removable parts 40*a*–40*c* and/or instrument 50 as described hereinabove. The recesses 52*a*–52*d* of the rearmost inner page 22 are sized so as to fit within the recesses 44*a*–44*d* of the back cover page 18 as best illustrated in FIG. 4. Although four recesses 44*a*–44*d* are illustrated, the back cover page 18 may contain any number of recesses.

As illustrated in FIG. 1, the front cover page 16 of the book may be printed with illustrations 64. The book 10 may be entitled, for example, "Why Frogs Can Jump" or any other title which implies that the book is an instructional book intended to teach children about the anatomy of a frog, any other animal or object. Other animals or objects other than a frog may be formed by the half shells 24, 30 in accordance with the present invention such as a bat, a whale, a snake head, a fish or a flower. Such books may be entitled, for example, respectively "How Bats Fly", "Why Whales Sing", "The Visible Viper", "How Fish Swim", "Why Flowers Bloom", etc.

In addition, the three-dimensional shell may be in the shape of an object such as a train, a turbine or other mechanical objects other than animals. The parts adapted to be placed inside such a shell may be the mechanical or electrical components of the object represented by the shell and/or half shells such as the parts of a plane or the parts of a turbine. Such books may be entitled, for example, "Why Planes Fly", "Why Turbines Turn", etc. Such books may teach a child about the mechanical or electrical composition of different objects and are to be used as a learning tool.

Regardless of the object represented by the shell of the book, the representation formed by the half shells 24, 30 must correspond to the subject matter of the book to aid in teaching the reader about the book's subject matter. Multiple removable parts may be adapted to fit inside the hollow three-dimensional shell and may be housed within recesses formed in one or more pages of the book. The reader may be able to remove one or more of the removable parts from the recesses and place the removable parts inside the hollow interior 38 of the three-dimensional shell 36; thus, learning more about how the parts fit together and where they are located in relationship to the outside peripheral surface of the animal or object. Text 58 may be written on the inside of the interior pages 20 as shown in FIG. 1 describing the different parts which are housed within the recesses 44 of the back cover page 18.

As best illustrated in FIGS. 1 and 2, the front cover page 16 and each of the planar inner pages 20 have a cut out portion 60 generally in the shape of the animal or object depicted by the hollow three-dimensional shell, in this case a frog. The cut out portion 60 has a peripheral edge 61 which follows the outline of the hollow three-dimensional shell 36 so that when the book is closed the front cover page 16 and the inner pages 20, which do not have a half shell integrally formed therein, may lie flat upon the pages containing the half shells as illustrated in FIGS. 1 and 4.

As best illustrated in FIG. 4, the recesses 44*a*–44*d* formed in the back cover page 18 each have a flat, planar bottom 62*a*–62*d*, respectively. The bottoms of the recesses 44*a*–44*d* are coplanar so that the bottom 62*a* of recess 44*a* is coplanar with bottom 62*b* of recess 44*b*, for example. The plane P defined by the recessed bottoms 62*a*, 62*b* is desirably below the bottom of the hollow three-dimensional shell 36 so that the book may lie flat on a desktop or other flat surface without the hollow three-dimensional shell 36 causing the book to wobble on the supporting surface or desktop.

Because the cut out portions 60 in the front cover page 16 and the planar inner pages 20 enable the front cover page 16 and planar inner pages 20 to lie flat upon each other and upon the rearmost inner page 22 containing the top half shell 24, the top half shell 24 protrudes above a plane defined by the front cover page 16 when the book's pages are closed, thus creating a non-typical book appearance. This non-typical book appearance with a front cover page which appears to be three-dimensional may attract the attention of potential customers and may cause a young child to become interested in the book. Additional illustrations 64 on the front cover page 18 provide an attractive environment for the front cover page 18 of the book.

Regarding the pages of the book, the front cover page 16 and the planar inner pages 20 may be colored different colors, for example yellow or orange, to increase the attractiveness of these pages to a child reader. The text thereon 58 may be in black or any other color to sharply contrast with the background color on these pages. The rearmost inner page 22 is preferably made of clear plastic so that the reader can see through the rearmost inner page 22 and view the different parts located within the recesses 44*a*–44*d* formed in the back cover page 18. Similarly, the back cover page 18 may also be made of clear plastic so that the reader may view the parts 40*a*–40*c* located in recesses 44*a*–44*c* when looking at the rear of the book. The top half shell 24 may be colored green so as to accurately depict the appearance of a frog, however, any other color may be used if desired.

Figure 5:
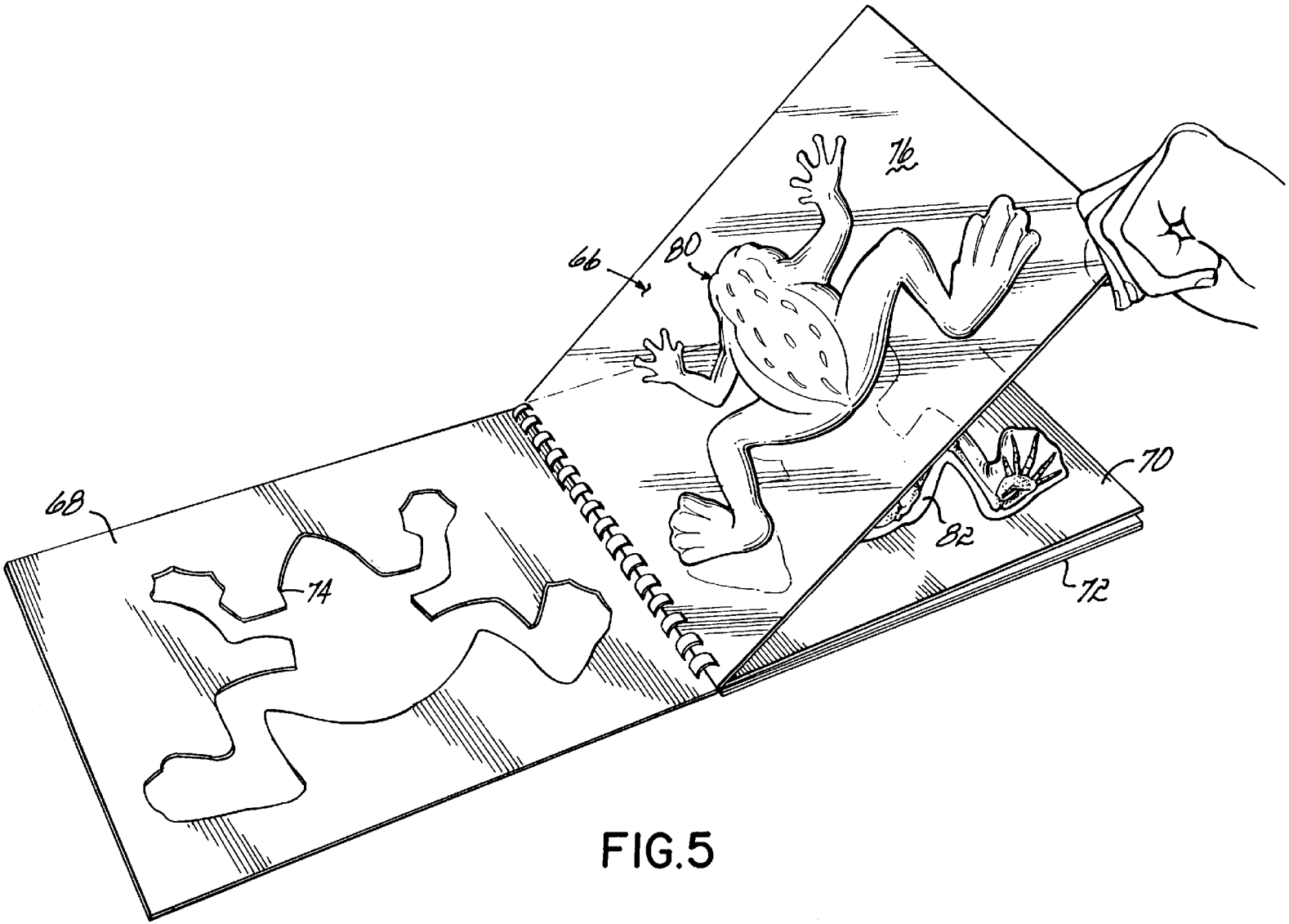
FIG. 5 is a perspective view of an alternative embodiment of the instructional book of the present invention.

Although this preferred embodiment having a top half shell 24 integrally formed in the rearmost inner page 22 and a bottom half shell 30 integrally formed in the back cover page 18 has been described in detail, the half shells may be integrally formed in other pages as well. For example, an alternative embodiment is illustrated in FIG. 5 in which a top half shell 80 is formed in a forwardmost inner page 66 located immediately behind the front cover page 68 and a bottom half shell 82 is integrally formed in another one of the interior pages 70 rather than the back cover page 72. In this embodiment, both the front cover page 68 and the back cover page 72 are substantially planar with cut out portions 74. Alternatively, any page, including the front and back cover pages, may have half shells integrally formed therein.

This alternative embodiment does not have recesses formed in the back cover page 72. Because the bottom half shell 82 is integrally formed in one of the interior pages 70 and the back cover page 72 has a cut out portion (not shown) through which the bottom half shell 82 passes this second embodiment of the book may, for some applications, be less desirable than the embodiment of FIGS. 1–4 because of instability resulting from the concave outer surface of the bottom half shell tilting or wobbling on a planar tabletop or desktop surface.

While I have described several embodiments of the present invention, persons skilled in the art will appreciate changes and modifications which may be made to the present invention without departing from the spirit of this invention. For example, the half shells may be contained on any of the pages of the book. Or alternatively, only a single three-dimensional half shell may be used for some applications. Therefore, I intend to be limited only by the scope of the following claims.

What is claimed is:

1. An instructional book comprising:

a front cover page and a back cover page, a plurality of inner pages sandwiched between said front and back cover pages, a first one of said pages having a top half shell integrally formed therein and a second one of said pages having a bottom half shell integrally formed therein, said half shells cooperating to form a hollow three-dimensional shell, binding means for binding said pages together.

2. The instructional book of claim 1 wherein said hollow three-dimensional shell is adapted to receive at least one removable part.

3. The instructional book of claim 1 wherein said back cover page has a plurality of recesses formed therein.

4. The instructional book of claim 3 wherein said first one of said pages has multiple recesses therein which fit into the recesses of the back cover page.

5. The instructional book of claim 1 wherein said front cover page is planar.

6. The instructional book of claim 4 wherein selected of said pages have registered cut out portions, the cut out portions being configured to allow said half shells to fit through the cut out portions.

7. The instructional book of claim 1 wherein selected of said pages have text written on the pages.

8. An instructional book comprising:

a substantially planar front cover page, a back cover page having a bottom half shell integrally formed in said back cover page, a plurality of substantially planar inner pages sandwiched between said front and back cover pages, a rearmost inner page having a top half shell integrally formed therein, said half shells cooperating to form a hollow three-dimensional shell adapted to receive at least one removable part, binding means for binding said pages together.

9. The instructional book of claim 8 wherein said back cover page has a plurality of recesses formed therein, said recesses being sized and adapted to hold removable parts.

10. The instructional book of claim 9 wherein said rearmost inner page has multiple recesses therein which fit into the recesses of the back cover page in order to hold said removable parts.

11. The instructional book of claim 8 wherein said front cover page and selected of said inner pages have registered cut out portions, the cut out portions being configured to allow said top half shell to fit through the cut out portions.

12. The instructional book of claim 8 wherein said inner pages have text written on them.

13. The instructional book of claim 8 wherein said hollow three-dimensional shell is in the shape of an animal.

14. An instructional book comprising a plurality of bound pages, a first page having a top half shell integrally formed in the first page, a second page having a bottom half shell integrally formed in the second page, said half shells cooperating to form a hollow three-dimensional shell, selected pages having cut out portions configured to allow said half shells to pass through the cut out portions.

15. The instructional book of claim 14 wherein said hollow three-dimensional shell is adapted to receive a removable object.

16. The instructional book of claim 14 wherein said hollow three-dimensional shell is in the shape of an animal.

17. The instructional book of claim 13 wherein said second page has a plurality of first recesses formed in the second page for storing parts to be inserted inside said shell.

18. The instructional book of claim 17 wherein said first page has a plurality of second recesses formed in the first page sized so as to be inserted inside the first recesses formed in the second page in order to hold said parts inside said first recesses.

19. An instructional book comprising a plurality of pages, most of said pages being substantially planar and having a cutout portion, two of said pages each having a half shell integrally formed in the page, said half shells cooperating to form a hollow three-dimensional shell, said cutout portions being configured in the shape of the shell enabling the half shells to pass through said cutout portions.

20. The instructional book of claim 19 wherein a first one of said pages has a plurality of recesses integrally formed therein capable of storing removable parts.

21. The instructional book of claim 20 wherein a second page has recesses therein which fit into the recesses of the first one of said pages.

22. The instructional book of claim 19 wherein said hollow three-dimensional shell is in the shape of an animal.

23. The instructional book of claim 19 wherein said pages are laminated.

24. An instructional book comprising:

front cover page and a back cover page, a plurality of inner pages sandwiched between said front and back cover pages, two of said pages having a half shell integrally formed therein, said half shells cooperating to form a hollow three-dimensional shell in the shape of an animal, binding means for binding said pages into a book.

25. An instructional book comprising:

a plurality of pages bound together including a front cover page, a back cover page and a plurality of inner pages sandwiched between said front cover page and said back cover page, two of said pages having a half shell integrally formed therein, said half shells cooperating to form a hollow three-dimensional shell.

26. The instructional book of claim 25 further comprising at least one object inside said hollow three-dimensional shell.

27. An instructional book comprising:

a plurality of pages bound together, a pair of said pages each having at least one convex half shell integrally formed therein, a pair of said half shells cooperating to form a hollow three-dimensional shell, at least one of said pages having a cut out portion enabling at least one of said half shells to pass through said cut out portion.

28. The instructional book of claim 27 further comprising at least one object inside said hollow three-dimensional shell.

* * * * *